US006394288B1

(12) United States Patent
Hartwall

(10) Patent No.: US 6,394,288 B1
(45) **Date of Patent: *May 28, 2002**

(54) MERCHANDISING RACK

(75) Inventor: John Hartwall, Söderkulla (FI)

(73) Assignee: Oy K. Hartwall AB, Soderkulla (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/647,064

(22) PCT Filed: Mar. 24, 1999

(86) PCT No.: PCT/FI99/00238

§ 371 (c)(1),
(2), (4) Date: Sep. 26, 2000

§ 102(e) Date: Sep. 26, 2000

(87) PCT Pub. No.: WO99/48408

PCT Pub. Date: Sep. 30, 1999

(30) Foreign Application Priority Data

Mar. 26, 1998 (FI) ..... 980152 U

(51) Int. Cl.[7] ..... A47B 73/00

(52) U.S. Cl. ..... 211/74; 211/59.2; 248/312.1

(58) Field of Search ..... 211/59.2, 74, 75, 211/106, 59.1, 181.1, 113, 162, 85.31; 248/312, 312.1, 314, 311.2, 309.1, 315; D6/462–465, 515, 566, 567, 569–572, 574; 312/42, 45, 72

(56) References Cited

U.S. PATENT DOCUMENTS

| | | | | | |
|---|---|---|---|---|---|
| 1,462,370 | A | * | 7/1923 | Lykins | 211/75 |
| 1,547,178 | A | * | 7/1925 | Long | 211/75 |
| 1,644,539 | A | * | 10/1927 | Minto | 211/75 |
| 1,958,781 | A | * | 5/1934 | Beukema | 248/312.1 |
| 2,051,408 | A | * | 8/1936 | Karst | 248/312.1 |
| 2,529,287 | A | * | 11/1950 | Garwood | 211/75 |
| 2,581,019 | A | * | 1/1952 | Heide | 211/59.2 |
| 2,692,053 | A | * | 10/1954 | Calhoun et al. | 211/59.2 |
| 2,772,787 | A | * | 12/1956 | Lee | 211/75 |
| 4,022,363 | A | * | 5/1977 | Eliassen | 211/74 |
| 4,310,097 | A | * | 1/1982 | Merl | 211/74 |
| 4,416,380 | A | * | 11/1983 | Flum | 211/181.1 |
| 4,742,923 | A | * | 5/1988 | Calvert | 211/59.1 |
| D308,924 | S | * | 7/1990 | Van Noord | D6/513 |
| 5,209,358 | A | * | 5/1993 | Simard | 211/74 |
| 5,669,527 | A | * | 9/1997 | Hardy | 211/74 |
| 5,695,074 | A | | 12/1997 | Wiese | |

(List continued on next page.)

FOREIGN PATENT DOCUMENTS

| | | |
|---|---|---|
| EP | 0 032 122 | 7/1981 |
| FR | 2 752 709 | 3/1998 |
| WO | WO 94/10885 | 5/1994 |
| WO | WO 96/25074 | 8/1996 |
| WO | WO 97/24049 | 7/1997 |

*Primary Examiner*—Daniel P. Stodola
*Assistant Examiner*—Jennifer E. Novosad
(74) *Attorney, Agent, or Firm*—Young & Thompson

(57) ABSTRACT

The merchandising rack for bottles, particularly for Ref-PET-type bottles with a substantially level collar in the neck area, includes elongated members made of material which is substantially circular in cross section, the members being attached to a supporting structure so that they are substantially perpendicular to the plane forming the supporting structure and arranged in pairs at a distance from each other which substantially corresponds to the thickness of a bottle neck so that when the bottle neck is fitted between the members, the bottle hangs from its collar on the members. To provide a stable support for the bottles the elongated members made of the material which is substantially round in cross section have sharp-edged parts which are parallel to the members and arranged to form the surfaces that support the bottles.

19 Claims, 2 Drawing Sheets

U.S. PATENT DOCUMENTS 5,706,956 A * 1/1998 Headrick et al. ..... 211/59.2
D393,388 S * 4/1998 Chen ..... D6/513
5,779,068 A * 7/1998 Whiten et al. ..... 211/59.2
5,785,189 A * 7/1998 Gollob et al. ..... 211/74
5,836,460 A * 11/1998 Brown et al. ..... 211/74
5,845,791 A * 12/1998 Kawolics ..... 211/59.2
5,878,862 A * 3/1999 Dewsnap ..... 211/74
D416,722 S * 11/1999 Hartwall ..... D6/553
6,189,734 B1 * 2/2001 Apps et al. ..... 211/59.2

* cited by examiner

MERCHANDISING RACK

BACKGROUND OF THE INVENTION

The invention relates to a merchandising rack for bottles, particularly for Ref-PET-type bottles, which are provided with a substantially level collar in the neck area, the merchandising rack comprising elongated members made of material which is substantially round in cross-section, the members being attached to a supporting structure so that they are substantially perpendicular to the plane forming the supporting structure and arranged in pairs at a distance from each other which substantially corresponds to the thickness of a bottle neck so that when the bottle neck is fitted between the members, the bottle hangs from its collar on said members.

DESCRIPTION OF THE RELATED ART

Merchandising racks described above are nowadays well known in the field of retail trade. Shelf-type solutions have been conventionally used as merchandising racks, in other words the bottles on sale have been placed on the shelf in an upright position. In this case the bottles stand on their bottoms on the shelf surface. This solution was very practical in connection with glass bottles which were used earlier, since glass bottles are very stable in the upright position, and thus they do not fall easily.

As Ref-PET-type bottles have become more common, problems have arisen particularly in the case of conventional shelf-type merchandising racks. The problems involve stability of the bottles. For technical reasons related to durability Ref-PET-type returnable bottles have to be provided with a certain shape. The bottom of these bottles, i.e. the surface that rests on the shelf surface, has a small diameter compared to the width and height of the bottle. The bottle shape results from the properties of the plastic material used in production, in other words, the bottle has to be provided with a certain shape if it is to satisfy certain durability requirements, for example. In practice, the above-mentioned problems mean that even a light push easily upsets the bottles, which may cause a lot of damage. The problem is emphasized particularly in merchandising racks from which customers, e.g. children, take bottles often in a hurry and carelessly. It may happen that the whole rack filled with bottles falls down. This results in an unpleasant situation for the customer, and at least in disorder and causes more work for the personnel. In the worst case some of the bottles are damaged so badly that they have to be withdrawn from sale. A further disadvantage related to the shelf-type solutions is the fact that the bottles placed at the rear edge of the shelf are not easily at hand, especially if the shelf is wide. In this case it may be necessary to move bottles near to the front edge of the shelf from time to time. This increases the work load of the shop personnel.

To eliminate the above-mentioned problems merchandising racks have been developed particularly for Ref-PET-type bottles. Such racks utilize the level collar in the neck area of the bottle so that bottles hang from their collars on the elongated members. An example of such a merchandising rack is the solution described in Finnish Utility Model No. 2388.

The solution described in Finnish Utility Model No. 2388 has been very practical when used with the Ref-PET-type bottles which were produced earlier and had a relatively large collar. Recently manufacturers have, however, introduced bottles with a substantially smaller collar, and consequently, it has been noted that the earlier merchandising racks designed for the bottle type in question are not as practical as they could be. It has been noted, for example, that in prior art merchandising racks bottles tilt easily because the small collar is not sufficiently supported by the elongated members which are substantially round in cross-section. The fact that the bottles are inadequately supported may even lead to a situation in which the bottles slip out of the rack and fall onto the floor.

SUMMARY OF THE INVENTION

The object of the invention is to provide a merchandising rack in which the drawbacks of the prior art solutions are eliminated. This is achieved with the merchandising rack of the invention which is characterized in that the elongated members made of material which is substantially round in cross-section are provided with sharp-edged parts which are parallel to the members and are arranged to form the surfaces that support the bottles.

A major advantage of the invention is that the problems that have come up in connection with bottles with a small collar can be eliminated in a very economical manner. A further advantage is that the invention does not in any way hinder the use of bottles provided with a larger collar, i.e. bottles provided with a large collar can be placed in the merchandising rack of the invention without difficulty. One advantage of the invention is its simplicity, and thus it is economical to introduce the invention. Production of the merchandising racks of the invention can be automated very economically, which also reduces the costs considerably.

BRIEF DESCRIPTION OF THE DRAWINGS

In the following, the invention will be described in greater detail by means of a preferred embodiment illustrated in the accompanying drawing, in which.

DESCRIPTION OF THE PREFERRED EMBODIMENTS

Figure 1:
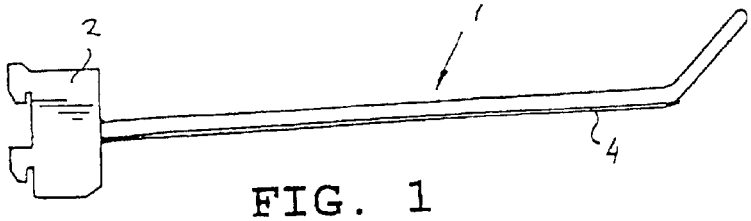
FIG. 1 is a side view of an essential part of a merchandising rack of the invention.
Figure 2:
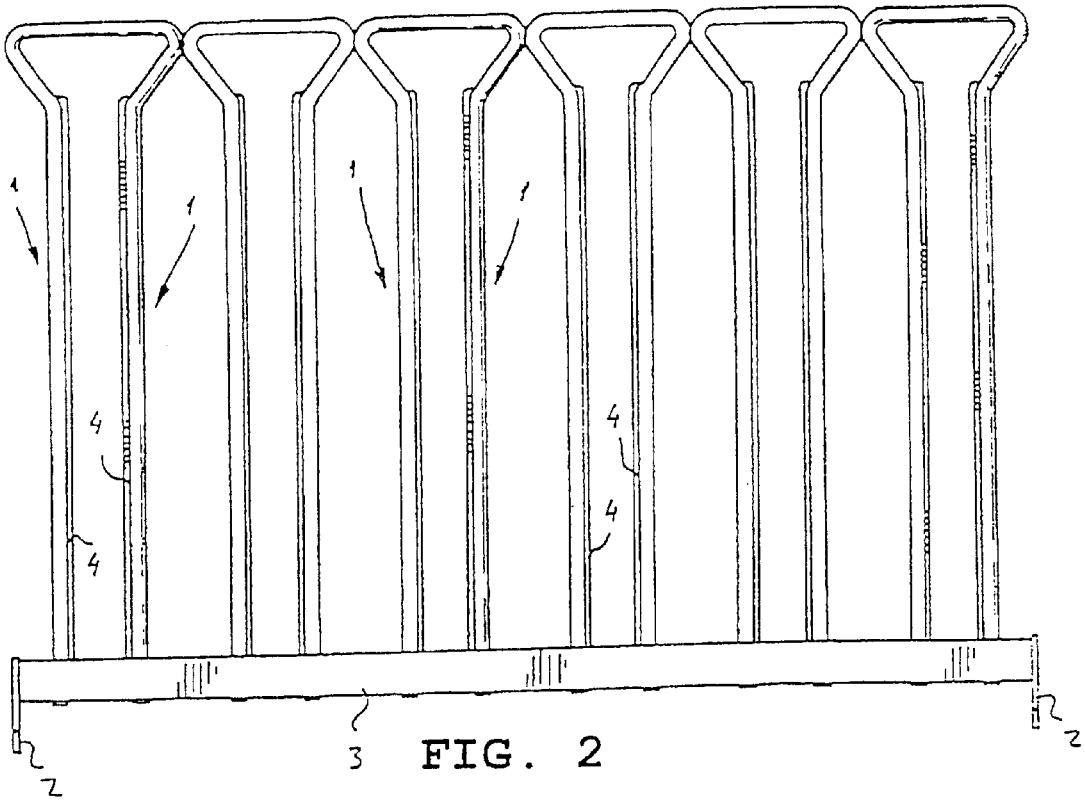
FIG. 2 is a top view of the part illustrated in FIG. 1.
Figure 3:
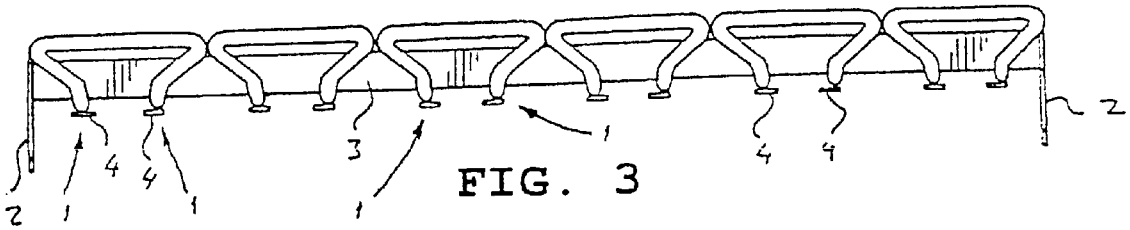
FIG. 3 is a front view of the part illustrated in FIGS. 1 and 2.
Figure 4:
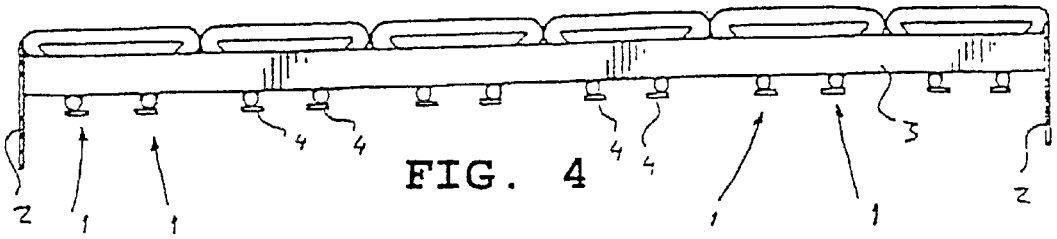
FIG. 4 is a back view of the part illustrated in FIGS. 1 to 3.

FIGS. 1 to 4 illustrate the essential part of the merchandising rack of the invention, i.e. the part that supports the bottles, from different directions. Elongated members, i.e. rails on which the bottles are placed, are indicated by reference number 1. Reference numbers 2 and 3 denote supporting parts which are used for providing the structure formed from the elongated members 1 and for arranging it on a suitable framework. The framework is not shown in the figures. The framework may be any suitable rack or the like in which a desired number of the structures according to FIGS. 1 to 4 can be arranged for example one on top of the other. The framework is fully conventional technology art to a person skilled in the art and thus it will not be described in greater detail here. In this connection a reference is made e.g. to Finnish Utility Model No. 2388 cited as the state of the art above.

As it is seen in the figures, the elongated members 1 are made from material which is substantially round in cross-section, i.e., circular, and the members are attached to a supporting part 3 so that they are substantially perpendicular to the plane forming the supporting structure and arranged in pairs at a distance from each other which substantially corresponds to the thickness of a bottle neck so that when the bottle neck is fitted between the members, the bottle hangs from its collar on the members in question. Since the size of the collar on the bottles has become smaller, it has been noted that supporting surfaces of the bottles made of material which is substantially round in cross-section do not function satisfactorily. This follows from the fact that the narrow collar is not supported by the uppermost section of the surface of the elongated member but by the oblique section of the surface, and thus the bottles are less stable than earlier. In such a situation even a light push causes the bottle to tilt and in the worst case it slips out of the rack and falls down.

An essential feature of the invention is that the elongated members 1 made of material which is substantially round in cross-section are provided with sharp-edged parts 4 which are parallel to the members 1 and are arranged to form the surfaces supporting the bottles 5, i.e., bottle collar hanging surfaces. The above-mentioned feature is seen particularly clearly in FIGS. 5 and 6, which illustrate part of FIGS. 3 and 4 in a larger scale.

Figure 5:
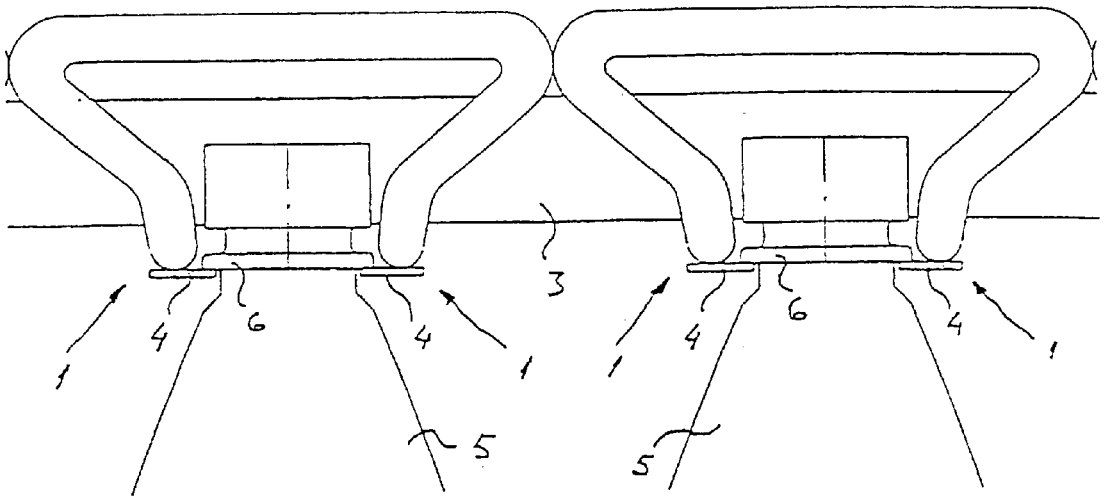
FIG. 5 is a enlarged side view of a detail of the part illustrated in FIGS. 1 to 4.
Figure 6:
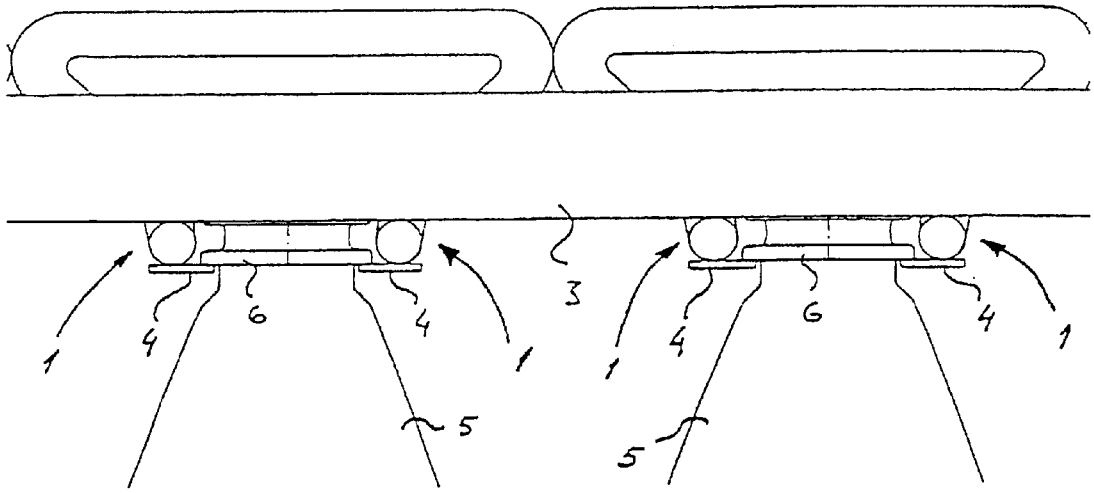
FIG. 6 is an enlarged back view of a detail of the part illustrated in FIGS. 1 to 4.

As can be seen in FIGS. 5 and 6, the collars 6 of the bottles 5 are pressed against the surfaces formed by the sharp-edged parts 4, in which case the bottles are supported by the elongated members in a very stable manner and the drawbacks related to the prior art solutions are eliminated.

The term "sharp-edged part" refers to a part other than the part which is round in cross-section. The cross-section of the sharp-edged part may be e.g. a rectangle. The edge itself does not need to be particularly sharp; instead the term mainly emphasizes the fact that the part in question is formed from substantially straight surfaces.

The sharp-edged parts may be formed e.g. from a flat part, which consists of parts made from flat iron, for example. These parts may be attached to the surface of the elongated member 1 in a suitable manner. They can be attached onto any surface of the elongated member, e.g. onto the lower surface like in the example illustrated in the figures, onto the upper surface, onto the surface opposite to another elongated member, etc. Attachment can be implemented in any suitable manner, e.g. by welding.

The flat part functioning as the sharp-edged part 4 and the elongated member 1 can be formed as an integral profile part, if such a structure is necessary. In this case the flat part may be positioned in the same way with respect to the elongated member 1 as was described above, i.e. on the lower surface, upper surface, etc.

The embodiment described above is by no means intended to limit the invention, but the invention may be modified completely freely within the scope of the appended claims. Thus it is obvious that the merchandising rack of the invention or its details need not be precisely as described above, but other solutions are also possible.

What is claimed is:

1. A merchandising rack for bottles having a substantially level collar (6) in a neck area, the merchandising rack comprising:

elongated members (1) made of material which is substantially circular in cross-section, the members being attached to a supporting structure so that they are substantially perpendicular to the plane forming the supporting structure and arranged in pairs at a distance from each other to provide a bottle-hanging space between the members, wherein the elongated members (1) made of the material which is substantially circular in cross-section are joined to sharp-edged parts (4) which are parallel to the members and are arranged to form bottle collar hanging surfaces.

2. A merchandising rack according to claim 1, wherein the sharp-edged parts (4) consist of a flat part.

3. A merchandising rack according to claim 2, wherein the flat part is attached onto the surface of the elongated member (1).

4. A merchandising rack according to claim 3, wherein the flat part is welded onto the lower surface of the elongated member (1).

5. A merchandising rack according to claim 2, wherein the flat part and the elongated member (1) are formed as a single integral part.

6. The merchandising rack of claim 1, wherein the sharp-edged parts are positioned to accept bottles.

7. A merchandising rack for hanging bottles by collars of the bottles, comprising:

a supporting part; and a plurality of elongated members arranged adjacent each other and attached at first ends to the supporting part, each of the members comprising a rail part attached to two flat plate parts, the rail part being substantially circular in cross-section and having two side-by-side rail portions with first ends that join the supporting part and second ends that join a connecting part, each one of the flat plate parts being attached to a respective one of the two side-by-side rail portions to form bottle collar hanging surfaces.

8. The merchandising rack of claim 7, wherein, the plurality of elongated members are arranged parallel to each other.

9. The merchandising rack of claim 7, wherein, the flat plate parts are joined parallel to the side-by-side rail portions.

10. The merchandising rack of claim 7, wherein, each of the flat plate parts has a rectangular cross-section.

11. The merchandising rack of claim 10, wherein, each of the flat plate parts has a rectangular shape.

12. The merchandising rack of claim 11, wherein, the flat plate parts are attached to a lower surface of the side-by-side rail portions.

13. The merchandising rack of claim 11, wherein, the flat plate parts are attached to a lower surface of the side-by-side rail portions.

14. A merchandising rack for supporting bottles by providing bottle neck collar hanging surfaces from which the bottles may hang, comprising:

a supporting part; and a plurality of elongated members attached to the supporting part, each of the members comprising a rail part having a connecting portion that joins two parallel straight portions, the rail part being circular in cross-section, a rectangular flat part attached to each of the two parallel portions and running along a length of each straight portion, the rectangular flat parts defining bottle neck collar hanging surfaces.

15. The merchandising rack of claim 14, wherein, the plurality of elongated members are arranged parallel to each other.

16. The merchandising rack of claim 14, wherein, the flat parts are joined parallel to the straight portions.

17. The merchandising rack of claim 14, wherein, the flat parts have a rectangular cross-section.

18. The merchandising rack of claim 14, wherein, each of the flat parts are attached to a lower surface of the straight portions.

19. The merchandising rack of claim 14, wherein, each of the flat parts are attached to a lower surface of the straight portions.

* * * * *